US008429826B2

(12) United States Patent
Clarke

(10) Patent No.: US 8,429,826 B2
(45) Date of Patent: Apr. 30, 2013

(54) SHAVING RAZORS AND CARTRIDGES

(75) Inventor: Sean Peter Clarke, Highmoor Cross (GB)

(73) Assignee: The Gillette Company, Boston, MA (US)

( * ) Notice: Subject to any disclaimer, the term of this patent is extended or adjusted under 35 U.S.C. 154(b) by 0 days.

(21) Appl. No.: 13/484,349

(22) Filed: May 31, 2012

(65) Prior Publication Data

US 2012/0233863 A1 Sep. 20, 2012

Related U.S. Application Data

(62) Division of application No. 12/542,141, filed on Aug. 17, 2009, now Pat. No. 8,209,867.

(51) Int. Cl.
*B26B 19/42* (2006.01)

(52) U.S. Cl.
USPC ..... 30/34.2; 30/34.05

(58) Field of Classification Search ..... 30/74.1, 30/70, 65, 50, 32, 34.2, 34.05, 77, 51
See application file for complete search history.

(56) References Cited

U.S. PATENT DOCUMENTS

| | | | | | |
|---|---|---|---|---|---|
| 2,064,878 | A | * | 12/1936 | Birrell | 30/55 |
| 2,600,880 | A | * | 6/1952 | Karle | 30/537 |
| 3,004,337 | A | * | 10/1961 | Schweizer | 30/58 |
| 4,044,463 | A | | 8/1977 | Tietjens | |
| 4,310,968 | A | | 1/1982 | Buik et al. | |
| 4,535,537 | A | | 8/1985 | Ferraro et al. | |
| 4,562,645 | A | | 1/1986 | Dato et al. | |
| 4,741,103 | A | | 5/1988 | Hultman | |
| 4,845,846 | A | * | 7/1989 | Sinka | 30/34.2 |
| 4,998,347 | A | | 3/1991 | Schachter | |
| 5,031,316 | A | * | 7/1991 | Oldroyd | 30/47 |
| 5,056,222 | A | * | 10/1991 | Miller et al. | 30/77 |
| 5,063,667 | A | | 11/1991 | Jacobson | |
| 5,191,712 | A | | 3/1993 | Crook et al. | |
| 5,313,705 | A | | 5/1994 | Rivers et al. | |
| 5,359,774 | A | * | 11/1994 | Althaus | 30/50 |

(Continued)

FOREIGN PATENT DOCUMENTS

| | | |
|---|---|---|
| EP | 0 314 266 A1 | 5/1989 |
| EP | 0 477 132 A1 | 3/1992 |

(Continued)

OTHER PUBLICATIONS

PCT International Search Report with Written Opinion in corresponding Int'l appln. PCT/US2009/058907 dated Jan. 21, 2010.

*Primary Examiner* — Sean Michalski
(74) *Attorney, Agent, or Firm* — John M. Lipchitz; Kevin C. Johnson; Steven W. Miller

(57) ABSTRACT

A shaving cartridge has a housing with at least one blade having a blade edge. A first guard is in front of the blade. The first guard has a plurality of projections defining a plurality of open slots extending generally transverse to the blade edge. Each slot has a leading end portion for receiving hairs and a trailing end portion for feeding the hairs to the blade. The projections are stepped with a height of the projections that define the leading end portion of the slots that is less than a height of the projections that define the trailing end portion of the slots.

19 Claims, 7 Drawing Sheets

U.S. PATENT DOCUMENTS

| | | | | |
|---|---|---|---|---|
| 5,365,665 | A | 11/1994 | Coffin | |
| 5,388,332 | A | 2/1995 | Oldroyd | |
| 5,410,810 | A | 5/1995 | Gillibrand | |
| 5,475,923 | A * | 12/1995 | Ferraro | 30/51 |
| 5,526,567 | A | 6/1996 | Carson, III et al. | |
| 5,590,468 | A * | 1/1997 | Prochaska | 30/41 |
| 5,802,721 | A * | 9/1998 | Wain et al. | 30/34.2 |
| 5,953,819 | A | 9/1999 | Simms et al. | |
| 6,085,421 | A | 7/2000 | Jorna et al. | |
| 6,233,829 | B1 * | 5/2001 | Oglesby et al. | 30/34.2 |
| 6,243,951 | B1 * | 6/2001 | Oldroyd | 30/34.2 |
| 6,298,557 | B1 | 10/2001 | Gilder | |
| 6,516,518 | B1 | 2/2003 | Garraway et al. | |
| 6,550,141 | B1 * | 4/2003 | Rivers et al. | 30/50 |
| 6,941,659 | B2 * | 9/2005 | Gilder | 30/34.2 |
| 7,111,401 | B2 | 9/2006 | Richard | |
| 7,540,088 | B2 * | 6/2009 | Takeshita | 30/34.2 |
| 2003/0159291 | A1 * | 8/2003 | Clark | 30/50 |
| 2005/0126007 | A1 | 6/2005 | Aviza | |
| 2005/0246898 | A1 * | 11/2005 | Gilder | 30/34.2 |
| 2006/0277759 | A1 * | 12/2006 | Follo | 30/50 |
| 2008/0250644 | A1 * | 10/2008 | Orloff et al. | 30/34.1 |
| 2009/0032043 | A1 * | 2/2009 | Gaugler | 132/148 |
| 2009/0188112 | A1 * | 7/2009 | Prochaska et al. | 30/34.05 |
| 2011/0146079 | A1 * | 6/2011 | Clarke et al. | 30/34.05 |
| 2011/0214290 | A1 * | 9/2011 | Micinilio et al. | 30/32 |

FOREIGN PATENT DOCUMENTS

| | | | |
|---|---|---|---|
| GB | 2 264 888 | A | 9/1993 |
| GB | 2 354 474 | A | 3/2001 |
| GB | 2 413 980 | A | 11/2005 |
| WO | WO 92/06827 | | 4/1992 |
| WO | WO 95/29043 | | 11/1995 |
| WO | WO 99/50034 | | 10/1999 |
| WO | WO 00/37227 | | 6/2000 |
| WO | WO 2004/069496 | A1 | 8/2004 |

* cited by examiner

SHAVING RAZORS AND CARTRIDGES

CROSS REFERENCE TO RELATED APPLICATIONS

This application is a divisional of U.S. application Ser. No. 12/542,141, filed Aug. 17, 2009 now U.S. Pat. No. 8,209,867.

FIELD OF THE INVENTION

The present invention relates to shaving razors and more particularly to shaving razor cartridges having a housing with a guard enabling for the orientation and passage of hair to a blade for efficient and effective shaving.

BACKGROUND OF THE INVENTION

In recent years shaving razors with numerous blades have been proposed in the literature and commercialized, e.g., in U.S. 2005/0039337 A1 published on Feb. 24, 2005, which generally describes a type of design that has been commercialized as the five bladed Fusion™ razor by The Gillette Company.

Many shaving consumers prefer the look and feel of a close smooth shave and thus shave on a daily basis; however, there is a population of consumers that prefer not to shave on a daily basis. These consumers may prefer the look and feel of hair growth of one or more days. These consumers are often referred to as "skippers" because they will skip shaving for one or more days. The shaving habits of skippers produce a problem for typical shaving razors because these razors are designed to shave effectively on a daily basis and are not specifically designed for the shaving habits of skippers.

Short hairs are typical of hair growth of approximately twenty-four hours. Standard shaving razors cut shorter hairs rather effectively because the short hairs have a tendency to stand straight up. The edge of a blade on the razor is able to cut the short hair at an optimum angle. Longer hairs typically bend over as they grow and lay flat on the skin The blade of a typical shaving razor will have the tendency to skive or cut the hair at a more parallel angle to the skin surface. Some hairs may lie flat such that the blade of the razor is unable to cut them. The user often has to shave the same area repeatedly to cut hairs that were either uncut or not cut close enough to the skin surface, resulting in increased skin irritation.

It is therefore desirable to provide a shaving razor with the increased safety and comfort of a guard that provides superior long hair cutting performance while minimizing skin irritation.

SUMMARY OF THE INVENTION

In one aspect, the invention features, in general, a shaving cartridge including a housing having at least one blade with a blade edge. The housing has a first guard having a plurality of projections defining a plurality of open slots extending generally transverse to the blade edge, wherein the open slots have a width of about 0.2 mm to about 0.49 mm and a pitch of about 0.40 mm to about 0.85 mm for allowing the free passage of hair during shaving. The number and spacing of the projections and slots of the first guard are dimensioned for smooth skin engagement to control skin flow and allow free passage of hair to the blade edge. Such a guard geometry of the cartridge avoids the discomfort caused by pressure points at ends of slots, skin bulges between the slots and the guard pulling on hair. If, desired, particular embodiments may optionally include open slots which extend completely through the cartridge to improve rinsing characteristics. Particular embodiments may also optionally include a second guard in front of the first guard for stretching the skin, wherein the second guard and the first guard define a longitudinal recess therebetween.

In another aspect, the invention features, in general, a shaving cartridge including a housing having at least one blade, wherein the blade has a blade edge. The housing has a first guard in front of the blade and the first guard has a plurality of projections that define a plurality of open slots extending generally transverse to the blade edge. The housing also has a second guard in front of the first guard. The second guard and the first guard define a longitudinal recess therebetween that is generally parallel to the blade. The longitudinal recess facilitates the release of any flat hairs back to a more upright orientation as the hair passes to the first guard. Particular embodiments may also optionally include the longitudinal recess having width of about 0.5 mm to about 1.5 mm to improve the release of hairs. If, desired, any of the embodiments may optionally include open slots which extend completely through the cartridge to improve rinsing characteristics. In addition, any of the embodiments may optionally include the first guard contacting the blade edge to improve safety and reduce nicks and cuts. Furthermore, any of the embodiments may include the open slots having a width of 0.20 mm to 0.49 mm and a pitch of 0.40 mm to 0.85 mm to align hairs in a more upright position and allow free passage of hair to the blade during shaving.

DETAILED DESCRIPTION OF THE INVENTION

Figure 1:
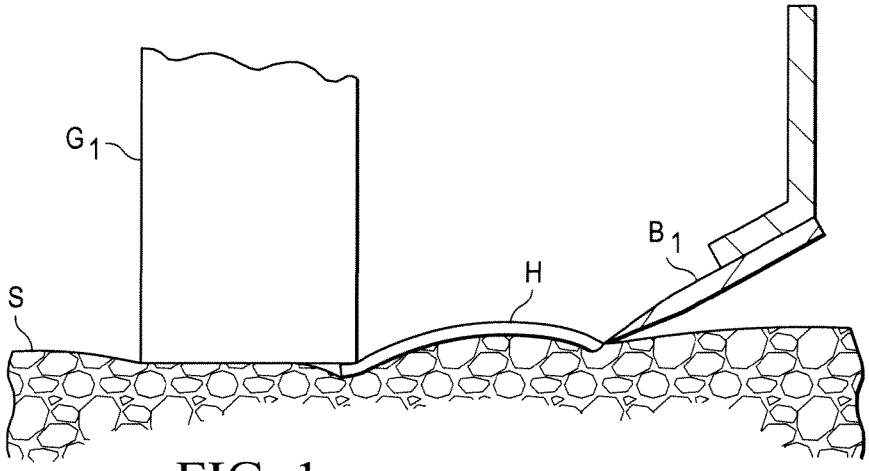
FIG. 1 is a cross sectional side view of a prior art shaving razor cutting a hair.
Figure 2:
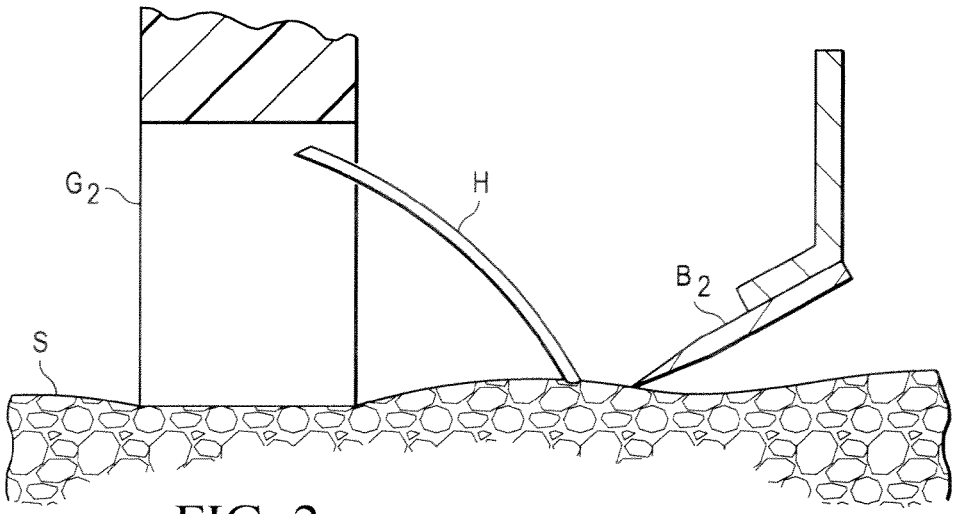
FIG. 2 is a cross sectional side view of a hair being cut by a simplified shaving razor in accordance with certain preferred embodiments of the present disclosure.

Referring to FIG. 2, the present invention is generally related to providing a shaving razor having a cartridge with a guard, $G_2$, that is capable of providing a passage for allowing hairs H, to stand up as they approach a blade, $B_2$, thereby providing for more precise cutting of longer hairs than is possible with the prior art devices shown in FIG. 1. As illustrated in FIG. 1, standard guards, $G_1$, can trap longer hairs H, so that they are held down against the skin, S, when the primary blade, $B_1$, is designed to engage them, resulting in the blade $B_1$, not properly cutting the hair H, close to the skin surface, S.

Figure 3:
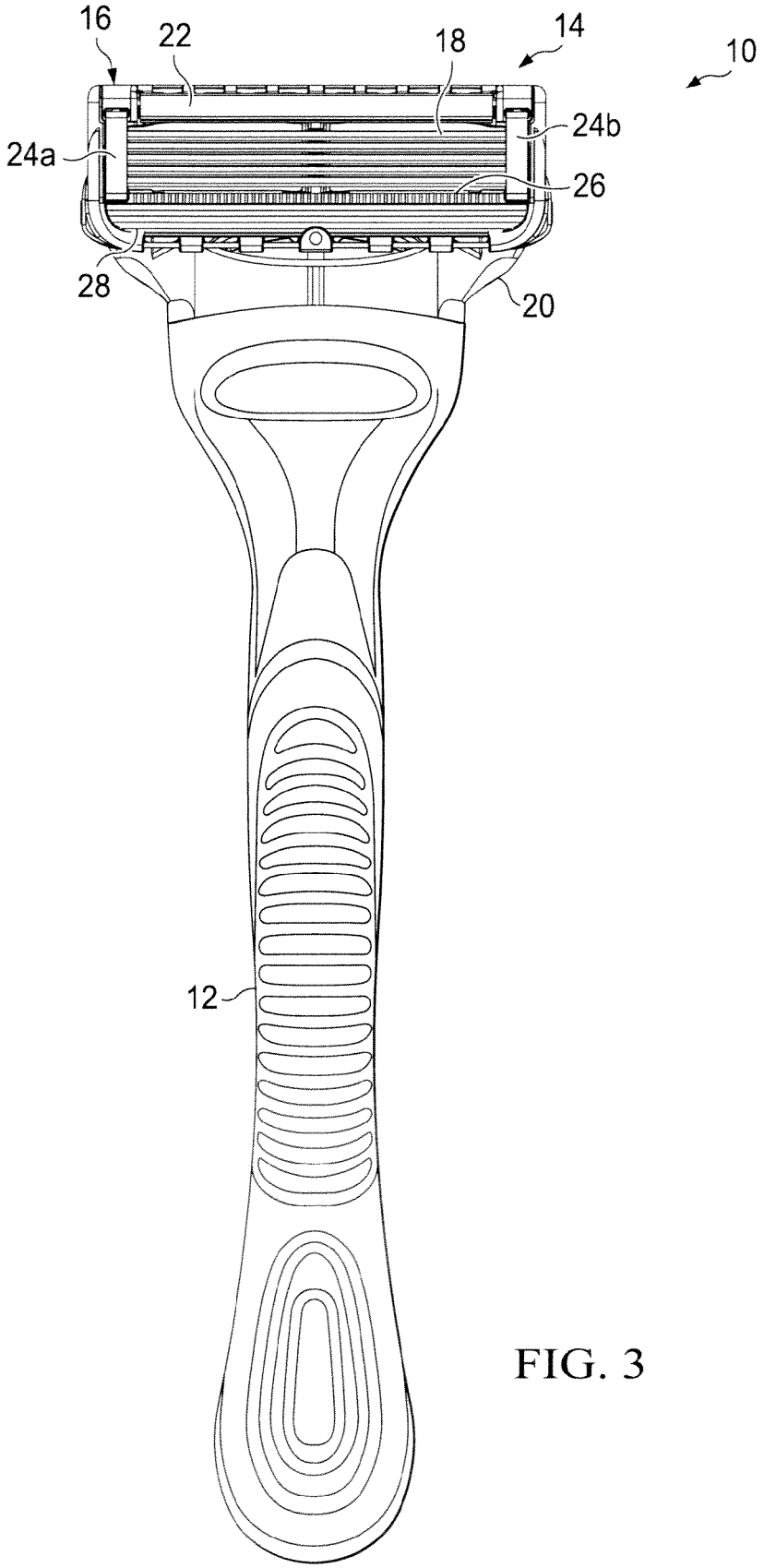
FIG. 3 is a front view of one possible embodiment of a shaving razor.

Referring to FIG. 3, one possible embodiment of the present disclosure is shown illustrating a shaving razor 10 having a handle 12 and a cartridge 14. In certain embodiments, the cartridge 14 may be detachably and pivotally mounted to the handle 12 with a connector 20. In other embodiments, the cartridge 14 may be mounted to or part of a double edge style shaving razor, such as the razor disclosed in U.S. Pat. No. 775,134. The shaving cartridge 14 may include a housing 16 having at least one blade 18 and a lubrication strip 22. In certain embodiments, the blades 18 may be mounted within the housing 16 and secured with at least one clip 24*a* and 24*b*. Other assembly methods known to those skilled in the art may also be used to secure and/or mount the blades 18 to the housing 16 including, but not limited to, wire wrapping, cold forming, hot staking, insert molding, and adhesives. A first guard 26 may be positioned in front of the blades 18 and a second guard 28 may be positioned in front of the first guard. The first guard 26 and/or the second guard 28 may be joined to or integral with the housing 16. For example the first guard 26 may be injection molded as part of the housing 16 and the second guard 28 may be insert molded or co-injection molded to the housing 16.

Figure 4:
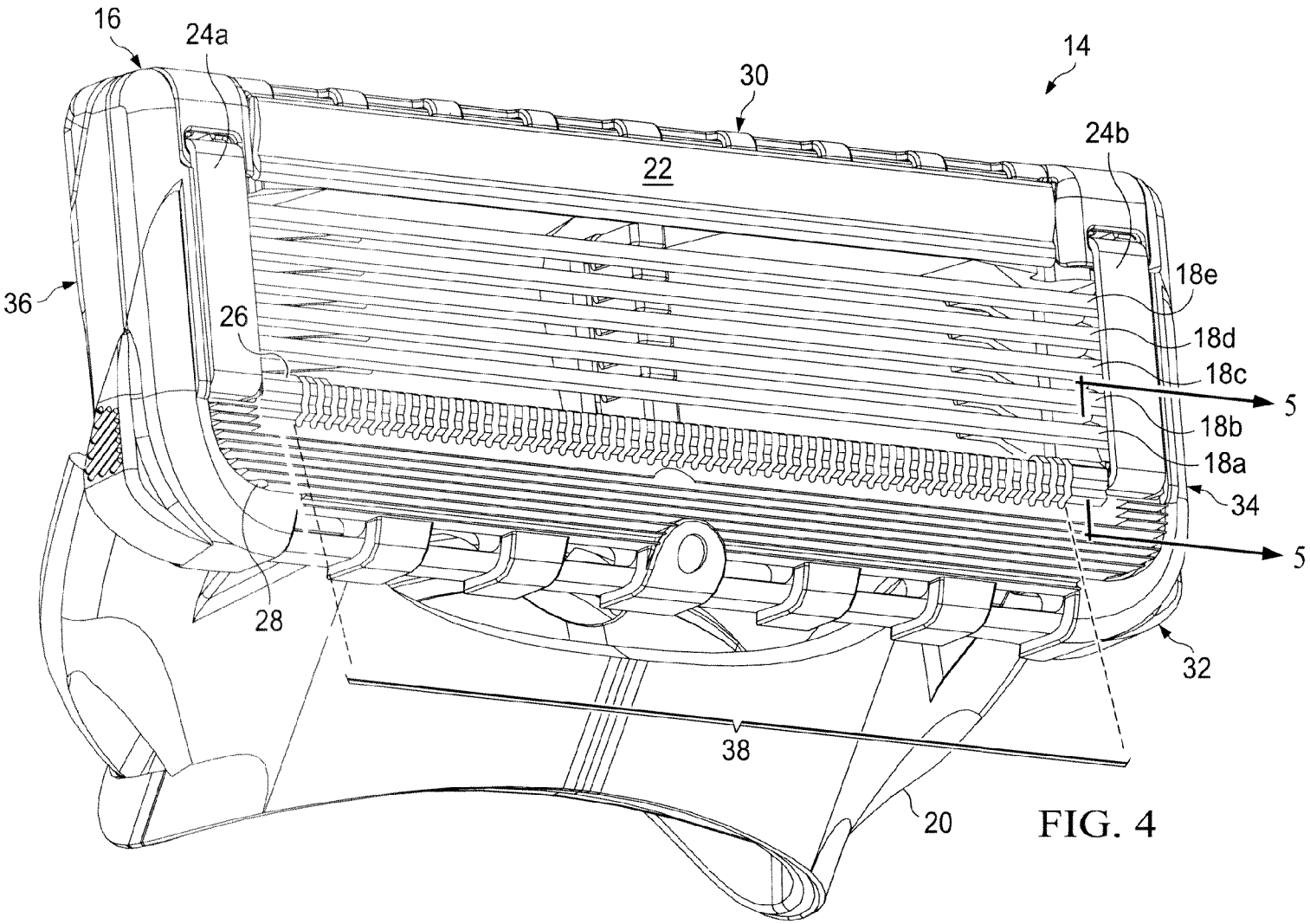
FIG. 4 is a perspective view of one possible embodiment of a cartridge, which may be incorporated into the shaving razor shown in FIG. 3.

Referring to FIG. 4, a perspective view is shown illustrating the housing 16 of the cartridge 14 attached to the connector 20. The housing 16 may have a proximal end portion 30, a distal end portion 32, a first lateral end portion 34, and a second lateral end portion 36. The lubricating strip 22 may be secured to the proximal end portion 30 of the housing 16 and may extend from the first lateral end portion 34 to the second lateral end portion 36. The at least one blade 18 may extend from the first lateral end portion 34 to the second lateral end portion 36 of the housing 16. In the embodiment shown, the housing 16 has a first blade 18*a*, a second blade 18*b*, a third blade 18*c*, a fourth blade 18*d* and a fifth blade 18*e*. Although five blades are shown it is understood that more or less blades 18 may be mounted within the housing 16. The blades 18 are shown secured within the housing 16 with the clips 24*a* and 24*b*, but other assembly methods known to those skilled in the art may also be used.

The first guard 26 may extend longitudinally from the first lateral end portion 34 to the second lateral end portion 36 and may be located at the distal end portion 32 of the housing 16 between the first blade 18*a* and the second guard 28. The first guard 26 may be located directly adjacent the first blade 18*a*. One or both of the first and second guards 26 and 28 may be integral with the housing 16 or may be secured to the housing using mechanical, thermal or chemical means. The second guard 28 may also extend longitudinally from the first lateral end portion 34 to the second lateral end portion 36. The housing 16 and the first guard 26 may be injection molded from a semi-rigid polymeric material having a Shore A hardness of about 50, 60, or 70 to about 90, 110, or 120. Alternatively, the housing 16 and the first guard 26 may be machined from a metal, such as stainless steel or aluminum. In certain embodiments the first guard may be molded from the same material as the housing 16, for example, Noryl™ (a blend of polyphenylene oxide (PPO) and polystyrene developed by General Electric Plastics, now SABIC Innovative Plastics). A metal or semi-rigid polymeric material may allow the housing 16 to maintain a consistent geometry during shaving and enhance the ability of the plurality of projections 38 to lift and orient hairs. The first guard 26 may be of sufficient stiffness such that the plurality of projections 38 do not bend or flex under normal shaving conditions, which may adversely influence shave geometry. The second guard 28 may be molded from a polymeric material with a Shore A hardness that is less than the Shore A hardness of the first guard 26. For example, the second guard 28 may be molded from a polymeric material with a Shore A hardness of about 20, 30, or 40 to about 50, 60, or 70. The second guard 28 may comprise thermoplastic elastomers (TPEs) or rubbers; examples may include, but are not limited to silicones, natural rubber, butyl rubber, nitrile rubber, styrene butadiene rubber, styrene butadiene styrene (SBS) TPEs, styrene ethylene butadiene styrene (SEBS) TPEs (e.g., TPEs supplied by Kraton Polymers), polyester TPEs (e.g., Hytrel®), polyamide TPEs (Pebax®), polyurethane TPEs, polyolefin based TPEs, and blends of any of these TPEs (e.g., polyester/SEBS blend). In certain embodiments, the second guard 28 may be molded from an elastomeric material, such as Kraiburg TC5GIL MS 34405 (KRAIBURG TPE GmbH & Co. KG of Waldkraiburg, Germany). A softer material (i.e., lower Shore A hardness) may enhance skin stretching, as well as provide a more pleasant tactile feel against the skin of the user during shaving. A softer material may also aid in masking the less pleasant feel of the harder material of the housing 16 and/or the first guard 28 against the skin of the user during shaving. The hardness of the first guard 28 may provide for optimum alignment of hairs during shaving and the softer second guard 38 may provide optimum skin stretching and tactile feel. In certain embodiments, the second guard 28 may be molded to the housing 16 using an insert molding or two shot molding manufacturing processes. Alternatively, the second guard 28 may be joined to the housing 16 utilizing adhesives, ultrasonic welding, mechanical fasteners, or other commonly used assembly methods know to those skilled in the art.

The first guard 26 may include a plurality of projections 38 that extend substantially transverse to the first guard 26 and the blades 18. The projections may extend along the entire length of the first guard 26, or they may extend along only certain sections of the first guard 26, such as the middle or ends. The first guard 26 may also extend only along certain sections of the housing 16, such as the middle or toward the end portions 34 and 36. As will be described in greater detail below, the first guard 26 and the projections 38 may be configured for the management of skin and may aid in guiding hair to the first blade 18*a*. The projections 38 and the first guard 26 may orient the hair in an upward direction away from the skin surface and present it to the first blade 18*a* to provide for efficient and accurate cutting of the hair. In certain embodiments, the first guard 26 and the projections 38 may be configured for guiding longer hairs to the blades 18. Long hairs may include hair that has not been shaved for longer than 48 hours. The length of such hairs may be greater than about 0.01 mm The cartridge 14 may also be used to cut hair with less than 72 hours of growth.

Figure 5:
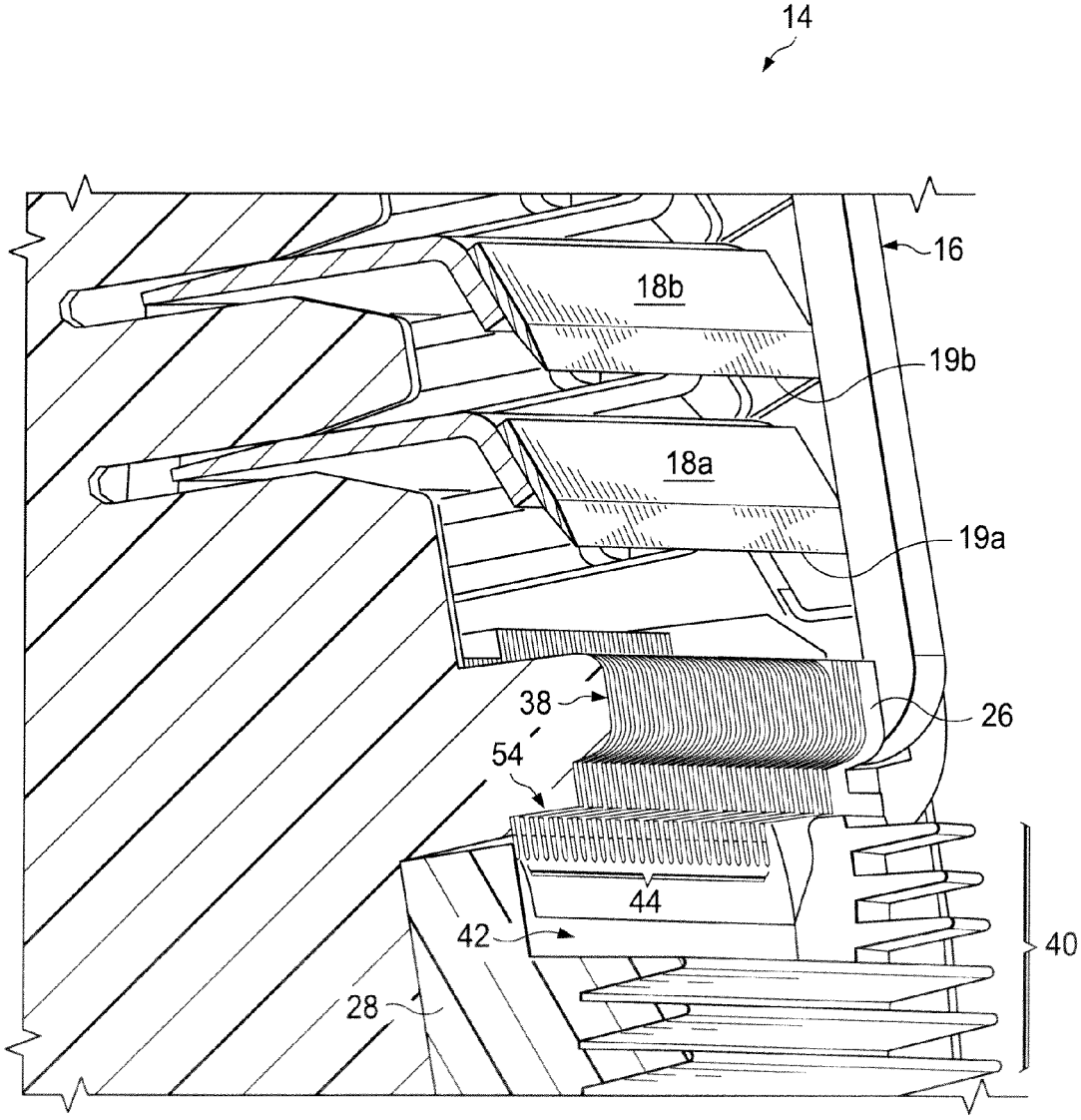
FIG. 5 is a detailed cross sectional view of the cartridge of FIG. 4.

Referring to FIG. 5, a detailed cross sectional view of the razor cartridge 14 is shown. The second guard 28 may have a plurality of fins 40 spaced apart from each other that extend longitudinally along a length the housing 16. Some of the fins 40 may extend substantially across the entire length housing 16, other fins 40 may extend only partially along the housing 16. The first guard 26 and the fins 40 of the second guard 28 may define a longitudinal recess 42 therebetween having a substantially flat top surface directly adjacent to the projections 38. The second guard 28 may enhance skin stretching, but may also trap hair and push the hair flat against the surface of the skin. If hair remains flat and does not stand up, then the blade 18 may not effectively cut the hair close to the surface of the skin. The longitudinal recess 42 may facilitate the release of any flat hairs back to a more upright orientation as the hair passes to the first guard 26. The fins 40 may work in combination with the longitudinal recess 42 to flip and orient the hair in a more upward direction. In certain embodiments, the longitudinal recess 42 may extend continuously along the length of the first guard 26, or the longitudinal recess 42 may include segments that extend in a discontinuous manner along the length of the first guard 26. The fins 40 can have different sizes, shapes and geometries. In particular, fins 40 can be in the form of nubs or fin segments that are spaced apart or interconnected. The fins 40 may also have different patterns or may be oriented at different angles with respect to the blades 18, e.g., in zigzag, chevron, herringbone or checkerboard patterns. The plurality of fins 40 can also take the form of spaced fin segments that are arranged in rows oriented generally parallel to the blades 18 or spaced fin segments that are arranged both parallel to and perpendicular to the blades 18.

The longitudinal recess 42 may extend substantially along the entire length of the first guard 26 and/or the first blade 18*a*. The longitudinal recess 42 may have a width of about 0.0 mm, 0.5 mm, or 0.75 mm to about 1.0 mm, 1.5 mm, or 20 mm to provide an open space between the fins 40 of the second guard 28 and plurality of projections 38 of the first guard 26. The plurality of projections 38 of the first guard 26 may define a plurality of slots 44 dimensioned for one or more hairs to pass through to the blade 18. In certain embodiments, there may be more than about 20 slots 44, more than about 40 slots 44, or even more than about 50 slots that spaced closely together. The total number of slots 44 may be greater than about 20, greater than about 40, greater than about 50, greater than about 60, greater than about 70, or even greater than about 80. There may be more or less slots 44, depending on the length and pitch of the cartridge 14. The number of slots 44 is based on a standard length cartridge 14, for example about 35 mm to about 45 mm, however, the cartridge 14 may have a length less than about 35 mm or greater than about 45 mm The large number of slots 44 may ensure that as much of the first blade 18*a* as possible is used to cut hairs passing though the first guard 26 (e.g., the slots 44 extend along a significant length of the first blade 18*a*).

The blades 18*a* and 18*b* (18*c* and 18*d* not shown) may each have a respective blade edge 19*a* and 19*b* dimensioned to cut the hair passing through the slots 44. The first blade edge 19*a* may be spaced apart from the first guard 26 by distance of about 0.75 mm to about 2.5 mm, however, the design of the first guard 26 may allow for a smaller distance between the first guard 26 and the first blade edge 19*a*. In certain embodiments, the spacing between the first guard 26 and the first blade edge 19*a* may be less than about 0.05 mm and may even touch the first blade edge 19*a* to improve safety and reduce nicks and cuts. The first blade edge 19*a* may be positioned below the top surface of the guard at a negative exposure. Hair may track through the slots 44 in the first guard 26 and cut by the first blade edge 19*a*, while the first guard 26 protects the skin.

The width of a human hair is about 0.10 mm If the width of the slot 44 is less than about 0.10 mm, then the hair may be caught up in the slot 44 and prevent other hairs from properly passing through the slot and to the blade 18*a*. If the width of the slot 44 is too small it may hamper proper rinsing of the slot 44 and blade 18*a*. Shaving aids, hair, dirt and debris may become trapped within the slot 44, the first guard 26 and around the blades 18, thus decreasing the effectiveness of the blades 18 to cut hair. This may become even more critical for users that shave infrequently. Longer hairs would be even more likely to become trapped and difficult to rinse out. The longer hairs would also be more likely to trap additional hairs, shaving aids, dirt and debris. If the slot 44, guard 26 and the blades 18 are not properly rinsed, the blades 18 will not properly cut the hair, which may result in nicks, cuts, uncut hairs and an inefficient shave that requires more passes of the blades 18 on the user's skin.

Standard guards can trap longer hairs so that they are held down against the skin when the primary or first blade is designed to engage them. The design of the first guard 26 allows for hairs to pass through without being trapped. If hair becomes trapped within or under a guard, successive or trailing hairs will not be able to be pushed upright by the guard and thus not presented properly to the first blade 19*a*. An upright hair has a greater likelihood of being cut closer by the first blade 19*a*. The first guard 26 also does not pinch the hair as it is cut, but allows the hair to pass through to be cut by the first blade 18*a*. The pinching of hair by guards often causes discomfort to the user. The top face of the first guard 26 manages skin flow and maintains the cartridge 14 geometry during shaving.

Figure 6A:
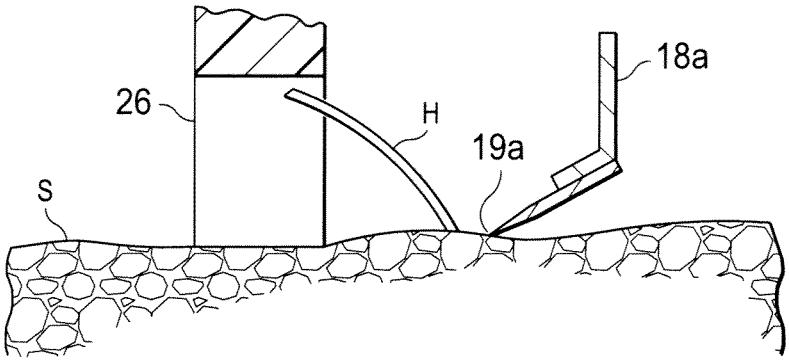
FIGS. 6A, 6B and 6C are cross sectional side views of a hair being cut by the shaving razor of FIG. 3.
Figure 6B:
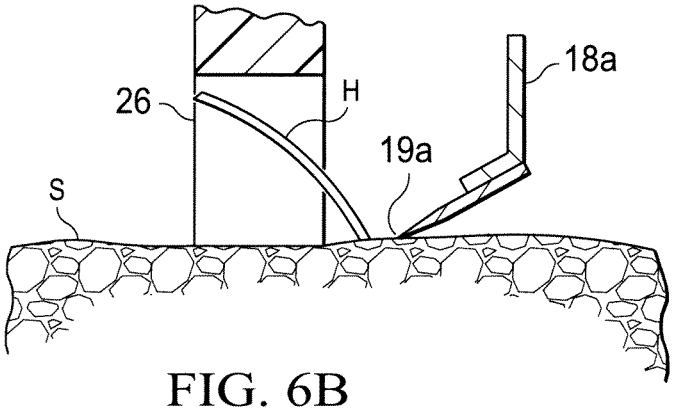
Figure 6C:
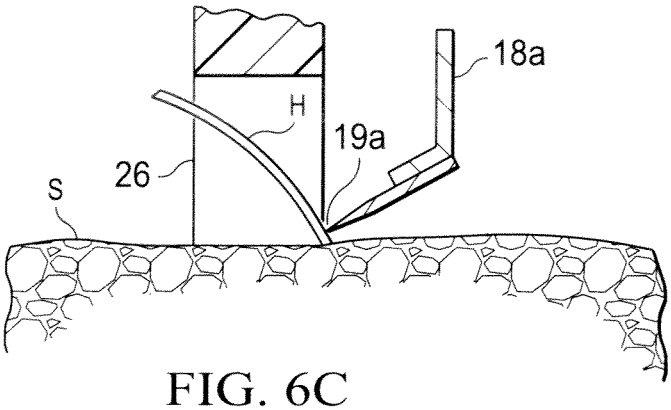

FIGS. 6A-6C illustrate the effect of decreasing blade span, which is the distance from the first guard 26 to the first blade edge 19*a*. Blade span may also be construed as the distance from one blade edge to an adjacent blade edge and the blade edges do not necessarily have to be the first blade edge 19*a*. FIG. 6A shows a cross sectional side view of a hair being cut by a shaving razor having a generally large blade span between first guard 26 and the first blade edge 19*a*. FIG. 6C illustrates a cross sectional side view of a hair being cut by a shaving razor having a generally small blade span between first guard 26 and the first blade edge 19*a*. FIG. 6B illustrates a cross sectional side view of a hair being cut by a shaving razor having an intermediate blade span between first guard 26 and the first blade edge 19*a*. Typically reducing the span between a blade 19*a* and the first guard 26 has the effect of improving safety, but decreasing efficiency since more of the blade 18*a* is masked by the guard 26 (as shown in FIG. 6C). Reducing the span between a blade edge 19*a* and the first guard 26 may also increase the probability of hairs being trapped under the guard, resulting in a missed or inaccurate cut. The design of the first guard 26 makes it possible to reduce the span, increasing safety whilst not impacting the efficiency. The first blade edge 19*a* may be masked by the first guard 26 for the skin but not for the hairs.

Figure 7A:
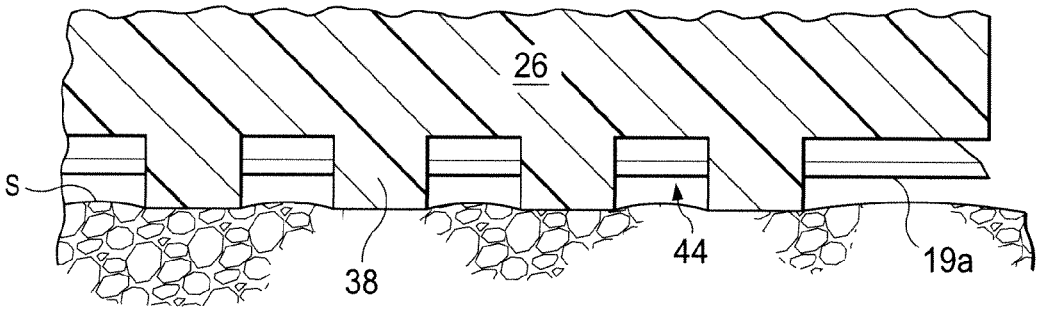
FIG. 7A is a detailed cross sectional view of one embodiment of a first guard which may be incorporated into the shaving razor shown in FIG. 3.
Figure 7B:
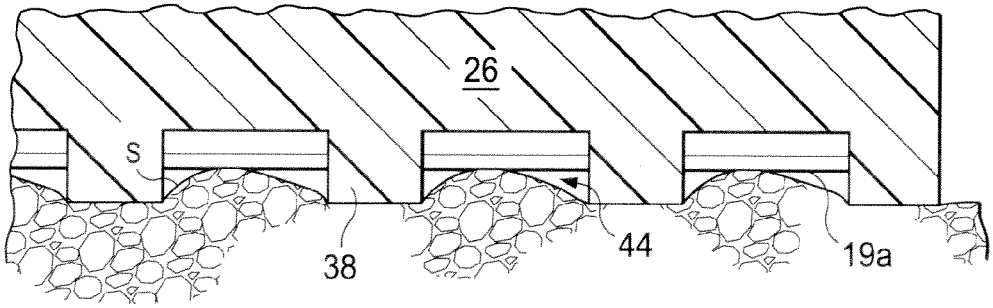
FIG. 7B is a detailed cross sectional view of another embodiment of a first guard.

Referring to FIGS. 7A and 7B, the first guard 26 is shown illustrating the effect of the size of the slots 44 on skin, S. FIG. 7A illustrates the first guard 26 having a plurality of projections 38 with optimal spacing. The slots 44 of the first guard 26 may be sized such that only hair travels through the slots 44, thus minimizing the exposure of skin to the blade edge. The blade edge 19*a* may be moved across the skin parallel to the blade edge 19*a* without slicing the skin, resulting in a safer design. As the slots 44 get wider, more skin can push up into the slot 44. Wider slots 44 and a flexible first guard 26 are less likely to maintain blade/guard geometry. FIG. 7B illustrates the first guard 26 having a plurality of projections 38 with increased spacing between adjacent projections 38, such that the skin bulges into the slots 44. The slots 44 expose more of the skin to the first blade edge 19*a*, which results in increased likelihood of nicks, cuts and slices. If the slots 44 are too narrow, hair will not pass through the slots 44, but will be gripped and pulled by the adjacent projections 38. The gripping and pulling of hair is very uncomfortable to the user and often results in hair becoming trapped in the slots 44. The hair is also difficult to rinse out because the hair becomes trapped within the narrow slots 44. The trapped hair then may interfere with cutting of hair in future shaves. The slot 44 should be small enough not to influence comfort, but large enough so hair is able to pass through freely. The first guard 26 also has the benefit of being rigid enough so the geometry of the slots 44 remains consistent during shaving, thus maintaining optimum blade-skin geometry resulting in a closer and more comfortable shave.

Figure 8:
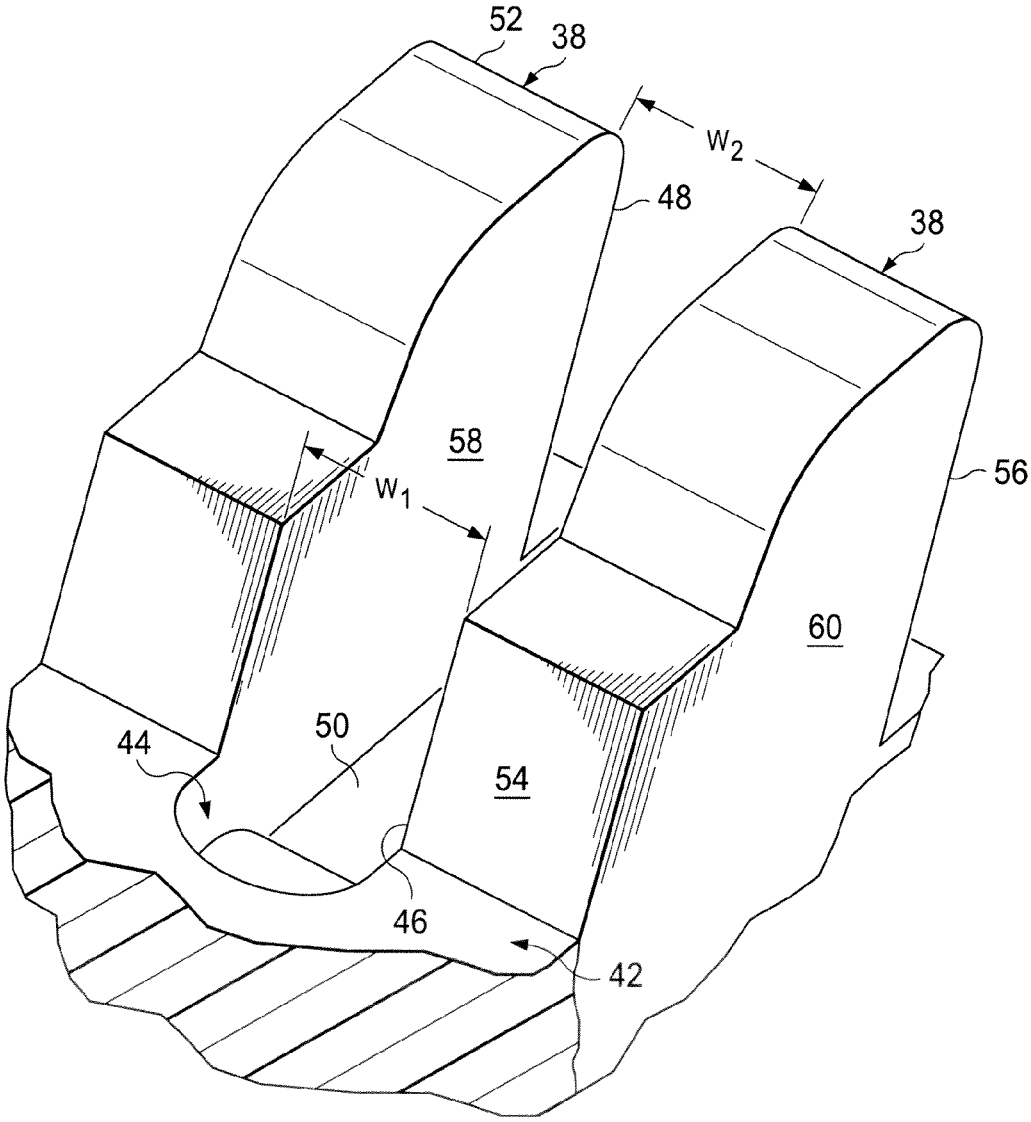
FIG. 8 is a detailed perspective view of the first guard of FIG. 7A.

Referring to FIG. 8 a detailed perspective view of two adjacent projections 38 is shown. The pair of adjacent projections 38 may define the slot 44 that is dimensioned to track hairs through with little or no interaction with the hair so the hair is not captured, trapped or pulled by projections 38, which may cause discomfort. The slots 44 and projections 38 are spaced to be as small as possible while not interacting with hair. The slots 44 and projections 38 are also dimensioned to reduce skin bulges and pressure points at ends of slots 44, which may result if the projections 44 or slots 38 are spaced to far apart. Skin bulges may lead to the blade edge 19*a* (not shown) unnecessarily cutting the skin, resulting in discomfort. The relatively larger number of projections 38 over the length of the first guard 26 may distribute the force placed on the skin by the cartridge 14 (not shown). The increased number of slots 44 may also increase the number of hairs passing through the slots 44 of the first guard 26, which may increase the number hairs that are properly cut by the first blade edge 19*a* (not shown).

The slot 44 may have a leading end portion 46 that receives one or more hairs and a trailing end portion 48 that feeds the hair to the blades (not shown) for cutting. The leading end portion 46 may have width $w_1$, of about 0.2 mm, 0.25, 0.3 mm to about 0.35 mm, 0.40 mm, or 0.49 mm The trailing end portion 48 may have a width $w_2$, that is less than $w_1$, to provide a tapered slot 44 for funneling hair to the blade 18. The leading end portion 46 of the slot 44 may have a chamfer or a lead in that tapers from the leading end portion 46 to the trailing end portion 48 to provide more efficient handling and passage of the hair.

The projections 38 may have a height as measured from a base 50 to a top surface 52 of the projections 38. The height of the projections 38 may be about 0.3 mm, 0.4 mm, or 0.50 mm to about 1.0 mm, 1.5 mm, or 2.0 mm In certain embodiments, the slots 44 may not have a base 50, thus the slots 44 may extend completely through the first guard 26 which may allow for uninterrupted flow of water during rinsing and cleaning. The projections 38 may have a length as measured from a front face 54 of the projection 38 to a rear face 56. The length of the projections 38 may be between about 0.3 mm, 0.4 mm, or 0.50 mm to about 1.0 mm, 15 mm or, 2.0 mm The slot 44 may extend beyond the front face 54 of the adjacent projections 38 resulting in a slightly greater length of the slot than the length of the adjacent projections 38. The height of the projections 38 may be tapered or stepped such that the height of the projections 38 that form the leading end portion 46 of the slots 44 is less than the height of the projections 38 that form the trailing end portion 48 of the slots 44. A step design may increase strength and may improve the tracking of hair into the slot 44. The pitch or spacing of the slot 44, as measured from a first side surface 58 of one of the projections 38 to a first side surface 60 of the adjacent projection 38, may be about 0.4 mm, 0.5 mm, or 0.6 mm to about 0.8 mm, 1.0 mm, or 1.5 mm The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A shaving cartridge comprising:

a housing having at least one blade with a blade edge;

a first guard in front of the blade, the first guard having a plurality of projections defining a plurality of open slots extending generally transverse to the blade edge, each slot having a leading end portion for receiving hairs and a trailing end portion for feeding the hairs to the blade, the projections are stepped wherein a height of the projections that define the leading end portion of the slots is less than a height of the projections that define the trailing end portion of the slots; and further comprising a second guard in front of the first guard, wherein the second guard, and the first guard define a longitudinal recess therebetween that is generally parallel to the blade.

2. The shaving cartridge of claim 1 wherein the slots have a width of about 0.20 mm to about 0.49 mm and a pitch of about 0.40 mm to about 0.85 mm for allowing the free passage of hair during shaving.

3. The shaving cartridge of claim 2 wherein the longitudinal recess has a width of about 0.5 to about 1.5 mm.

4. The shaving cartridge of claim 3 wherein the second guard has a plurality of spaced apart fins.

5. The shaving cartridge of claim 3 wherein the second guard comprises a material having a Shore A hardness that is less than that of the first guard.

6. The shaving cartridge of claim 5 wherein the longitudinal recess has a substantially flat top surface directly adjacent to the projections.

7. The shaving cartridge of claim 5 wherein the slot extends beyond a front face of the adjacent projections.

8. The shaving cartridge of claim 7 wherein a length of the slots is greater than a length of the projections.

9. The shaving cartridge of claim 2 wherein the projections have a length from a front face to a rear face of about 0.50 mm to about 2.0 mm.

10. The shaving cartridge of claim 2 wherein the slots extend completely through the first guard.

11. The shaving cartridge of claim 2 wherein the projections have a height from a base of the projections to a top surface of the projections of about 0.5 mm to about 1.5 mm.

12. The shaving cartridge of claim 2 wherein the slots have a width of about 0.30 mm to about 0.35 mm.

13. The shaving cartridge of claim 2 wherein the projections have a trailing end portion adjacent the blade and a leading portion, wherein a width of the leading portion is greater than a width of the trailing portion.

14. The shaving cartridge of claim 1 wherein the second guard comprises one or more fins and the first guard the one or more fins of the second guard define the longitudinal recess.

15. The shaving cartridge of claim 1 wherein the second guard and plurality of projections of the first guard define and open space there between.

16. The shaving cartridge of claim 1 wherein the projections contact the blade.

17. The shaving cartridge of claim 1 wherein the projections are spaced apart from the blade.

18. The shaving cartridge of claim 1 wherein the first guard has more than about 40 slots along the length of the first guard.

19. The shaving cartridge of claim 1 wherein the slots have a width of about 0.25 mm to about 0.4 mm.

* * * * *